United States Patent [19]

Larkin

[11] 4,118,028

[45] Oct. 3, 1978

[54] PITCHING TARGET WITH BALL COLLECTOR

[76] Inventor: Edward P. Larkin, 400 Stanton Ave., Cincinnati, Ohio 45174

[21] Appl. No.: 794,747

[22] Filed: May 9, 1977

Related U.S. Application Data

[63] Continuation-in-part of Ser. No. 785,767, Apr. 7, 1977, abandoned.

[51] Int. Cl.[2] ..... A63B 63/04

[52] U.S. Cl. ..... 273/26 A; 273/102.4

[58] Field of Search ..... 273/26 A, 102.4, 105 R, 273/181 R, 181 A, 181 F

[56] References Cited

U.S. PATENT DOCUMENTS

| | | | |
|---|---|---|---|
| 1,142,184 | 6/1915 | Lawrence | 273/102 R |
| 1,566,945 | 12/1925 | Winkley | 273/181 F |
| 1,629,907 | 3/1927 | Dwyer | 273/102.4 |
| 2,254,986 | 9/1941 | Ziel | 273/26 A |
| 2,827,297 | 3/1958 | Foster | 273/102.4 |
| 2,988,360 | 6/1961 | Lambiotte | 273/26 A |
| 3,328,033 | 6/1967 | Hendry | 273/105 A |
| 3,428,318 | 2/1969 | Vick | 273/101 |
| 3,575,415 | 4/1971 | Fulp | 273/105 R |

FOREIGN PATENT DOCUMENTS

| | | | |
|---|---|---|---|
| 1,428,811 | 10/1969 | Fed. Rep. of Germany | 273/105 R |
| 21,781 of | 1902 | United Kingdom | 273/105 R |

*Primary Examiner*—Richard C. Pinkham
*Assistant Examiner*—Lawrence E. Anderson
*Attorney, Agent, or Firm*—Wood, Herron & Evans

[57] ABSTRACT

A pitching target having strike and non-strike zones, including two superimposed lightweight and highly flexible sheets suspended from the top in face to face relation, with the front sheet having apertures in the strike zone and apertures below the non-strike zone for collecting pitched balls incident on the strike and non-strike zone. Balls pitched at the target, after collection via passage through the apertures in the front sheet, fall between the sheets to the bottom thereof where they are stored until manual removal via access slots provided in the front sheet above the region where the balls are stored. The target may be used to effectively catch tennis balls, golf balls and hockey pucks projected at high velocity.

10 Claims, 5 Drawing Figures

PITCHING TARGET WITH BALL COLLECTOR

This application is a continuation-in-part of my earlier filed application Ser. No. 785,767, Apr. 2, 1977 now abandoned.

This invention relates to ball pitching targets, and more particularly to ball pitching targets having both strike and non-strike zones and means to collect and store pitched balls striking either the strike zone or the non-strike zone.

To assist baseball and softball pitchers to improve their pitching accuracy, practice targets have been proposed. These targets typically include, at the very least, a clearly delineated area called a "strike zone", and often also include a "non-strike zone". The pitcher practices his pitching by repeatedly throwing, or pitching, balls at the strike zone of the target. Pitched balls incident on the target in the strike zone presumably would be considered "strikes" by an umpire. Whereas, pitched balls missing the strike zone, and incident on the non-strike zone if there is one, would presumably be considered by an umpire to be "balls". The pitcher practicing pitching, by observing where his pitched balls strike the target, can assess the accuracy of each pitch and attempt to improve his game by repeatedly pitching at the target.

Pitching targets of various kinds have been proposed heretofore. Few, if any, having both strike and non-strike zones, are known to have been proposed which are capable of collecting and storing, for subsequent removal at the convenience of the user, pitched balls which have struck the target in the strike zone as well as in the non-strike zone. Accordingly, it has been an objective of this invention to provide a pitching target which collects pitched balls striking the target regardless of whether in the strike zone or the non-strike zone.

Another shortcoming of many of the pitching targets heretofore proposed is that they are rather elaborate structurally, and once set up are more or less semi-permanent in nature. Accordingly, it has been a further objective of the invention to provide a pitching target which can be set up and readied for use, as well as placed in a condition for storage, rapidly and without need for any special tools or mechanical expertise.

A further and equally important disadvantage of the pitching targets which have been proposed in the past is that even if they can be disassembled for storage when not in use, they are rather bulky even in a disassembled state and cannot be conveniently and compactly stored. Thus, a still further objective of this invention has been to provide a pitching target which is very compact and readily stored.

Finally, many of the pitching targets which have been proposed in the past have been relatively expensive in terms of both the cost of materials and the labor necessary to assemble them. Another objective of the invention, therefore, has been to provide a pitching target which uses inexpensive and readily available materials and which requires a minimum of assembly labor, thereby minimizing cost.

The foregoing objectives have been accomplished in accordance with the principles of the invention by providing a pitching target which, in a preferred form, includes a pair of superimposed relatively lightweight, highly flexible sheets which are suspended from a rigid horizontal bar by flexible supports at a plurality of space points along their upper edge. The front sheet is provided with an apertured strike zone and at least one laterally adjacent, or juxtaposed, non-apertured non-strike zone. Also provided in the front sheet is a horizontal array of spaced ball capture openings located below the juxtaposed strike and non-strike zones.

A pitched ball incident in the strike zone of the target passes through the strike zone aperture in the front sheet, and strikes the rear sheet, moving it rearwardly to provide a space between the front and rear sheets. When the ball's forward or pitched, horizontal motion has been terminated by the rear sheet, the ball descends vertically under the force of gravity between the sheets to a ball collection zone located between the sheets at the bottom thereof. A pitched ball striking the target in the non-strike zone above the horizontally disposed array of ball collection apertures moves the front and rear sheets rearwardly in the localized area of impact, causing the lower edge of the ball collecting aperture underlying the point of impact to become spaced horizontally relative to the upper edge thereof, effectively opening the underlying ball collecting aperture. As soon as the forward motion of the ball has terminated, the ball falls downward adjacent the outer surface of the front sheet under the force of gravity into the underlying ball collection aperture which is now momentarily open. Continued downward motion of the ball between the front and rear sheets deposits the ball in the ball collection zone at the bottom thereof. Suitably provided access openings in the front sheet above ball storage zone facilitates manual removal of stored balls at the convenience of the user. By reason of the fact that the pitching target of this invention is made primarily of lightweight flexible sheet material, such as a pair of bedsheets, the cost of the materials used in making the target is minimal. The labor cost is also modest since assembly involves little more than providing openings in the front sheet, stitching the sheets together along certain portions of their bottom and lower side edges, and suspending the sheets from their upper edges at spaced points with flexible supports, such as lengths of rope, from a stationary horizontal rigid bar. Additionally, and again by reason of the fact that the principal structural material of the target is nothing more than a pair of flexible sheets, the target can be compactly folded for convenient storage.

Another advantage of the pitching target of this invention is that it can be very quickly and rapidly set up for use by merely suspending it from a horizontal support, such as a limb of a tree, the ceiling of a basement in a home or the like. Of course, and as noted, the pitching target of this invention effectively collects and stores, for subsequent removal through suitably provided access openings in the front sheet, balls incident on the non-strike zone as well as the strike zone.

These and other advantages, features and objectives of the invention will become more readily apparent from a detailed description thereof taken in conjunction with the drawings in which.

Figure 1:
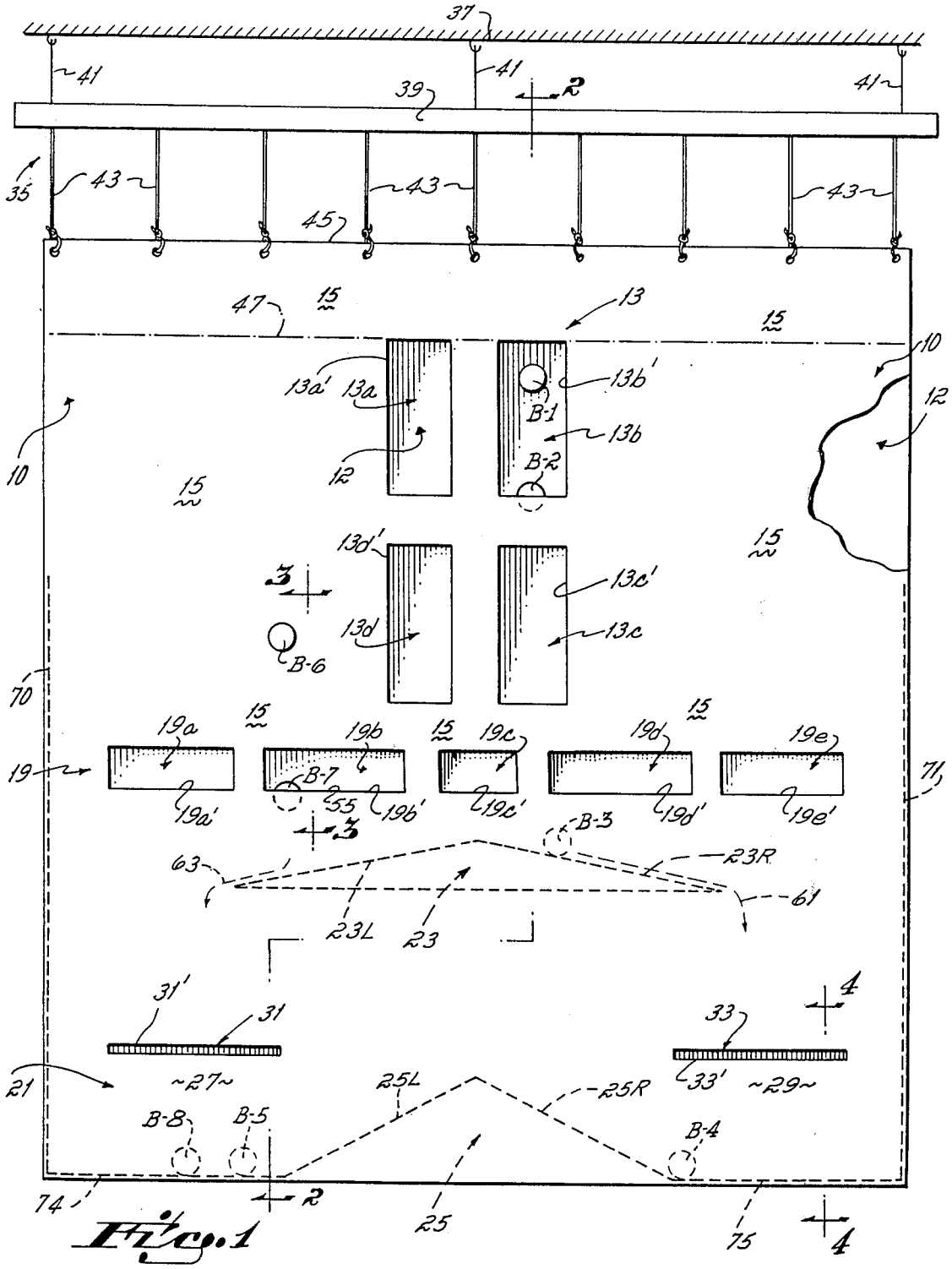
FIG. 1 is a front elevational view of the ball pitching target of this invention showing it supported along its upper edge and extending vertically its entire vertical length.

The ball pitching target of this invention includes a front sheet 10 and a rear sheet 12 which are in face-to-face superimposed relation. Front and rear sheets 10 and 12 are preferably indentically shaped and rectangular. Sheets 10 and 12 are constructed of relatively lightweight and highly flexible sheet stock. For example, in practice it has been found that front and rear sheets 10 and 12 can be constructed of conventional bed sheeting material. For reasons to become apparent hereafter, front and rear sheets 10 and 12 should not be constructed of relatively heavyweight stiff material.

The superimposed rectangular front and rear sheets 10 and 12 include a strike zone 13 centrally disposed in the upper half of the pitching target. As viewed by a pitcher, the strike zone 13 includes upper and lower right and left strike zone corners 13*a*, 13*b*, 13*c* and 13*d*. Assuming a righthanded batter is standing forward of the front sheet 10 and to the right of the strike zone 13, strike zone corner 13*a* corresponds to a pitched strike in the upper outside portion of the strike zone; strike zone corner 13*b* corresponds to a pitched strike in the upper inside corner of the strike zone; strike zone corner 13*c* corresponds to a pitched strike in the lower inside corner of the strike zone; and strike zone corner 13*d* corresponds to a pitched strike in the lower outside corner of the strike zone.

The front and rear sheets 10 and 12, in addition to the strike zone 13 also includes non-strike zones 15 and 17 surrounding the centrally disposed strike zone 13. Located below the strike and non-strike zones 13, 15 and 17 is a non-strike collection or capture zone 19 disposed horizontally below the bottom of the strike and non-strike zone across substantially the entire width of the pitching target. The strike zone 13, in a manner to be described more fully hereinafter, functions to collect or capture pitched balls which strike the target in the strike zone. The non-strike collection or capture zone 19 as will be described hereinafter in more detail, functions to collect or capture pitched balls which do not strike the target in the strike zone 13.

The lower portion of the pitching target includes a storage section 21 for pitched balls which strike the target in the strike zone 13 or the non-strike zones 15 and 17. The ball storage section 21 includes upper and lower captured ball diverters 23 and 25, respectively, as well as left and right (as viewed by the pitcher) ball storage sections 27 and 29. The ball storage section 21 further includes left and right stored ball removal zones 31 and 33, each comprising a horizontal slot 31' and 33' formed in the front sheet 10 above the storage zones 27 and 29, respectively.

The pitching target of this invention also includes a target support assembly 35 for supporting, in generally vertically disposed planar disposition, the front and rear sheets 10 and 12 from a stationary support 37. Support 37 may take the form of the ceiling of a room if the pitching target is installed in a room, or if the pitching target is installed outdoors, the limb of a tree or a horizontal bar of a suitable stationary framework of some kind, such as the horizontal bar of a football goal post.

The target support assembly 35, considered in more detail includes a horizontally disposed rigid bar 39, for example, a length of pipe or wood plank. The bar 39 is supported at at least two spaced apart points, preferably at at least its opposite ends, to facilitate maintaining the bar 39 disposed horizontally and avoiding pivotal motion of the bar about a vertical axis. At those points where the bar 39 is supported by the stationary support 37, suitable support elements, such as lengths of rope or the like, 41 are used to interconnect the support 37 and the bar 39. The target support assembly 35 further includes a plurality of flexible support elements 43 interconnecting the bar 39 and the upper edge 45 of the front and rear sheets 10 and 12. The flexible supports 43 preferably are at least approximately one foot each in length and spaced apart from each other somewhere in the range of 6–18 inches to facilitate substantial deflection of the target sheets 10 and 12 in the region of impact when a pitched ball strikes the target in the region below the upper edge 45 and above an imaginary horizontal line 47 passing through the upper horizontal edge of the strike zone 13. It is desirable to avoid securing the upper edge 45 of the target directly to the bar 39, because, if such is done, the sheets 10 and 12 in the region between edge 45 and imaginary line 47 become undesirably stiff. If too stiff, when a pitched ball strikes the target in the region between edge 45 and imaginary line 47, the sheets 10 and 12 do not deflect rearwardly in the localized area of impact sufficiently to facilitate subsequent collection or capture of the ball in the zone 19 when the ball has terminated its horizontal motion and drops vertically. The flexible supports 43 may be adjusted in length, either increased or decreased, to provide proper retention of balls pitched at high or low speed, respectively. For much the same reason, namely collecting balls hitting the target at high speed in the non-strike zone 15 and 17, it is desirable that the sheets be fabricated of lightweight and highly flexible material so as to effectively enfold and give in a horizontal motion to reduce the ball's velocity and to capture, gently deposit the ball into the collector and return to position for the next pitch.

Figure 2:
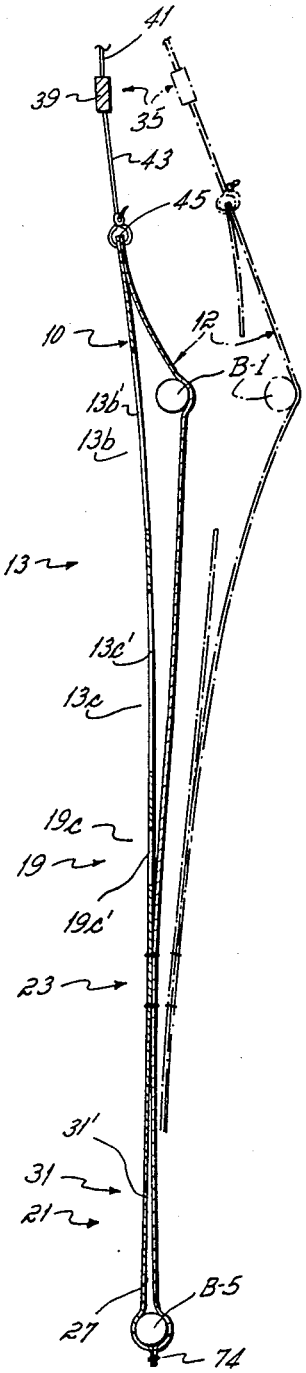
FIG. 2 is a cross-sectional view taken along line 2—2 of FIG. 1 showing a ball striking the rear sheet of the target after passing through a strike collection, or capture, aperture in the front sheet of the target.

To collect pitched balls which strike the target in the corner strike zones 13*a*, 13*b*, 13*c* and 13*d* rectangular openings 13*a'*, 13*b'*, 13*c'* and 13*d'* are provided in the front sheet 10 which are coextensive in size and shape with their respectively associated corner strike zones 13*a*, 13*b*, 13*c* and 13*d*. In operation, and with reference to FIG. 2, when a pitched ball strikes the target in the upper right strike zone corner 13*b*, for example, ball designated with reference numberal B-1, it passes through the opening 13*b'* and strikes the rear sheet 12, causing both sheets 10 and 12 to deflect rearwardly and the rear sheet to deform locally at the point of impact, as shown in FIG. 2. When the forward horizontal motion of the ball B-1 has been terminated by the rear sheet 12, the sheets 10 and 12 are in the phantom line position shown in FIG. 2. In said position the rear sheet in the region where it has been struck by the ball B-1, is spaced horizontally from the plane of the front sheet 10. Under such circumstances, when the ball B-1 drops vertically under the force of gravity, it falls between the sheets 10 and 12 (see ball designated B-2) where it is ultimately deflected laterally to the right (see ball designated B-3) by the upper captured ball diverter 23, to be described hereafter, eventually dropping vertically into the right ball storage section 29 (see ball designated B-4).

The upper captured ball diverter 23 preferably consists of outwardly and downwardly inclined lines of stitching 23L and 23R joining the front and rear sheets 10 and 12. When a ball, such as the ball designated B-3, is descending vertically between the sheets 10 and 12 and strikes the upper captured ball diverter 23, for example, the righthand diverting stitch line 23R, the ball B-3 rolls as indicated by dotted line 61 in an outwardly and downwardly direction. When the ball B-3 has passed outboard of the lower right end of the stitch line 23R, it falls vertically downwardly into the ball storage region 29. Once a captured ball, such as Ball B-3, drops into one of the captured ball storage sections 27 or 29, such as ball B-4 in the right ball storage region section 29, it is maintained in that section below the right stored ball removal aperture 33' by the lower captured ball diverter 25.

The lower captured ball diverter 25 preferably includes downwardly and outwardly sloping lines of stitches 25L and 25R joining the front and rear sheets 10 and 12. Stitch lines 25L and 25R maintain captured balls, such as ball B-4 and B-5 stored in the right and left storage sections 29 and 27, respectively, in their respective storage section once they have arrived.

The non-strike collection or capture zone 19 includes a plurality of individual capture zones **19*a*, 19*b*, 19*c*, 19*d* and 19*e*, each including a rectangular aperture 19*a'*, 19*b'*, 19*c'*, 19*d'* and 19*e'* in the front sheet 10. In a manner to be described hereafter, pitched balls striking the non-strike zone 15 are captured via apertures 19*a'* and 19*b'* while pitched balls striking the non-strike zone 17 are captured via apertures 19*b'* and 19*e'*. Pitched balls striking the target anywhere above the aperture 19*c'*, except within one of the corner strike zones 13*a*, 13*b*, 13*c* or 13*d* will be captured via the aperture 19*c'***.

Figure 3:
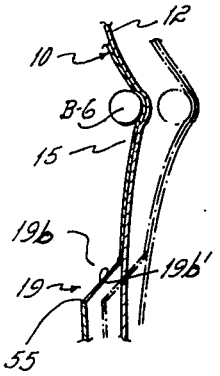
FIG. 3 is a vertical cross-sectional view along line 3—3 of FIG. 1 of a portion of the pitching target showing a ball striking the non-strike zone thereof, and the non-strike collection or capture aperture therebelow in an open condition to receive the ball when it drops.
Figure 4:
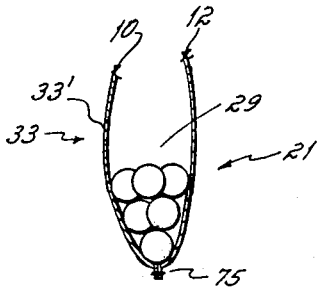
FIG. 4 is a vertical cross-sectional view along line 4—4 of FIG. 1, showing pitched balls which have struck the strike and/or non-strike zones and subsequently been captured and stored.

In use, when a ball strikes either the left or right non-strike zone 15 or 17, such as the ball designated with reference numeral B-6 striking the left non-strike zone 15, the ball deflects the front and rear sheets 10 and 12 rearwardly to the phantom line position, and deforms the sheets in the region of the point of impact, as shown in FIG. 3. The deflection and deformation of the front and rear sheets 10 and 12 by the ball B—6 causes the lower edge 55 of the non-strike capture aperture **19*b'* to become horizontally spaced from the portion of the front and rear sheets 10 and 12 located thereabove. With the lower edge 55 of the non-strike capture aperture 19*b'* so spaced, the ball B-6, after it strikes the non-strike zone 15 and has had its horizontal motion terminated, will fall vertically under the force of gravity through the aperture 19*b'* (see ball designated B-7) and continue its downward descent between the front and rear sheets 10 and 12. As the ball B-7 continues moving downwardly it eventually strikes the diverter stitch line 23L of the upper captured ball diverter 23 and rolls downwardly and leftwardly following the path designated by dotted line 63. When the ball passes beyond the lower outer end of the diverter stitch line 23L, it drops vertically down into the left ball storage section 27** to assume, for example, the position shown by the ball designated with the reference numeral B-8.

Balls striking the target between the upper right and left corner strike zones **13*a* and 13*b* are captured and stored in one or the other of the ball storage sections 27 and 29 via the capture aperture 19*c'* in much the same manner that a ball striking the non-strike zone 15**, such as ball *b*-6, is captured via the aperture **19*b'*. Similarly, a pitched ball striking the target between the lower left and right strike zone corner sections 13*b* and 13*d* will be captured via the capture aperture 19*c'***.

As noted, the left and right stored ball removal zones 31 and 33 each include a slot or elongated aperture 31' and 33' in the front sheet 10. The apertures 31' and 33' are disposed above the ball storage sections 27 and 29 to facilitate manual removal of balls stored in the section, such as balls B-5, B-8 and B-4, by insertion of the user's hand into the ball storage sections via the appropriate slot 31' or 33'.

The sheets 10 and 12 are stitched to each other along the lower one-half of their left and right vertical edges as shown by stitched lines 70 and 71. Stitch lines 70 and 71 facilitate ball retention between sheets 10 and 12 during downward motion thereof, of balls which have been captured via the apertures **19*a'*–19*e'*. It is unnecessary to stitch the sheets 10 and 12 to each other along their respective upper vertical edge portions. The sheets 10 and 12 are stitched to each other along the bottom edge, as shown by diverter stitch lines 25L and 25R and stitch lines 74 and 75 located along the lower left and right edges of the target, to facilitate retention of captured balls which have fallen between sheets 10 and 12** to the bottom of the target.

Figure 5:
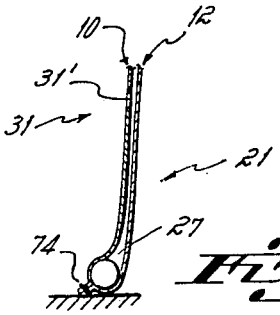
FIG. 5 is a vertical cross-sectional view showing the ball storage region of the pitching target in its normal orientation in use in which the lower region thereof is supported on the ground.

In practice, the pitching target of this invention is normally suspended from its upper edge by assembly 35 at a height such that the lower portion rests on the ground as shown in FIG. 5. With the target so suspended, and the bottom portion resting on the ground, the lower portion of the target tends to remain more or less stationary below the upper portion of the target notwithstanding that pitched balls repeatedly strike the target and locally deflect the sheets 10 and 12 at the area of impact. Stated differently, by so suspending the target with its lower portion on the ground, the lower portion of the target tends to remain in place due to the friction which exists between the ground and the lower portion of the target which is in contact with it. When positioned on the ground, low pitches striking the ground are stopped and usually caught in the ball collectors. If desired, the target could be suspended at a height such that its lower portion does not rest on the ground. Such a design would be adequate for advanced pitchers who are desirous of improving control pitching in and close to the target zone.

Although it is preferred that the target edges 74 and 75 be stitched to contain balls between sheets 10 and 12 in storage sections 27 and 29 and ball removal slots 31' and 33' be provided to facilitate convenient ball removal, both stitched sections 74, 75 and the slots 31' and 33' can be omitted. Of course, containment of collected balls within storage sections 27 and 29 is not then assured.

If desired, the sheets 10 and 12 can be made of contrasting colors to accentuate said strike zone 13.

I claim:

1. A pitching target for collecting and storing pitched balls incident on strike and non-strike zones thereof, comprising:

a front sheet of lightweight highly flexible material adapted to substantially deform and deflect at localized areas of impact when incident with a pitched ball while suspended vertically from its upper edge whereby the forward motion of said incident ball is arrested and said ball falls downwardly under the force of gravity along a vertical path proximate said front sheet;

a rear sheet of lightweight highly flexible material adapted to substantially deform and deflect at localized areas of impact when incident with a pitched ball while suspended vertically from its upper edge whereby the forward motion of said incident ball is arrested and said ball falls downwardly under the force of gravity along a vertical path proximate said rear sheet;

suspension means for vertically suspending said front and rear sheets in superimposed face to face relationship, including a rigid elongated, horizontal support and a plurality of flexible elements interconnecting said support and said upper edges of said sheets at horizontally spaced points; the length of said elements and horizontal spacing being sufficient to permit substantial deflection of said front and rear sheets in the region of impact with a pitched ball;

said front sheet having a generally rectangular strike zone and at least one unapertured non-strike zone disposed horizontally, laterally on each side of said strike zone in juxtaposition therewith, said strike zone having at least one strike aperture therein, a pitched ball corresponding to a strike passing through said strike aperture to impact and locally deflect and deform said rear sheet in the region behind said strike aperture to horizontally space said sheets proximate said strike aperture and fall vertically downward between said sheets following arrest of said ball's forward motion by said rear sheet;

a ball collection aperture in said front sheet having vertically spaced upper and lower edges, said ball collection aperture being located below and in substantial vertical alignment with at least one of said non-strike zones, a pitched ball impacting anywhere within one of said non-strike zones of said front sheet above said ball collection aperture locally deflecting and deforming said front and rear sheets in the region of said impact to horizontally space said upper edge of said collection aperture rearwardly relative to said lower edge to open said collection aperture below said impact region such that the ball enters between the upper and lower edges of the collection aperture in order to collect said ball between said sheets as it falls downwardly after its forward motion has been arrested, by said front sheet; and said front and rear sheets cooperating to define a ball storage zone underlying at least one of said strike and non-strike zones at a level below said ball collection aperture for storing balls collected by said strike and ball collection apertures which move downwardly between said sheets.

2. The pitching target of claim 1 further including at least one access opening in at least one of said sheets communicating with said ball storage zone to facilitate manual removal of balls stored therein.

3. The pitching target of claim 2 wherein there are two access openings located at points horizontally spaced apart, said target further including a captured ball deflector joining said front and rear sheets proximate said storage zone, said deflector located generally centrally of said access openings to deflect collected balls toward one or the other of said access openings for convenient removal therethrough.

4. The pitching target of claim 3 wherein said deflector includes a stitched seam joining said front and rear sheets.

5. The pitching target of claim 2 further including a captured ball deflector joining said front and rear sheets proximate said storage zone and located relative to said access opening to deflect collected balls toward said access for covenient removal therethrough.

6. The pitching target of claim 5 wherein said deflector includes a stitched seam joining said front and rear sheets.

7. The pitching target of claim 2 wherein said front and rear sheets are joined to each other at least along their opposite vertical side edges below said ball collection aperture to maintain between said sheets collected balls during their vertical descent in said storage zone, and wherein said front and rear sheets are joined along their lower margins to maintain between said sheets in said storage zone collected balls which have come to rest following termination of said vertical descent.

8. The pitching target of claim 1 wherein said front and rear sheets are joined to each other at least along their opposite vertical side edges below said ball collection aperture to maintain between said sheets collected balls during their vertical descent in said storage zone.

9. The pitching target of claim 1 wherein said rigid support includes an elongated rigid bar and at least two separate support elements respectively connecting spaced adjacent opposite ends of said bar to a stationary support to limit pivoting of said bar about a vertical axis and to maintain said bar generally horizontally disposed.

10. The pitching target of claim 1 wherein said front and rear sheets are contrasting in color to accentuate said strike zone.

* * * * *